United States Patent [19]

Franzer

[11] 4,014,750

[45] Mar. 29, 1977

[54] SUPPORT APPARATUS FOR A BATTERY OF COKE OVENS

[75] Inventor: Wolfgang Franzer, Wattenscheid, Germany

[73] Assignee: Dr. C. Otto & Comp. G.m.b.H., Bochum, Germany

[22] Filed: Jan. 22, 1975

[21] Appl. No.: 543,155

[30] Foreign Application Priority Data

Jan. 24, 1974 Germany ..... 2403266

[52] U.S. Cl. ..... 202/139; 202/222; 202/223; 52/573

[51] Int. Cl.² ..... C10B 1/06; C10B 1/00; E04B 1/68

[58] Field of Search ..... 202/133, 138, 139, 145, 202/220, 222, 223, 224; 52/194, 251, 274, 573; 110/1 A, 1 C, 24; 61/53.5

[56] References Cited

UNITED STATES PATENTS

| | | | |
|---|---|---|---|
| 958,154 | 5/1910 | Mueller | 202/139 |
| 1,099,932 | 6/1914 | Peiter | 202/222 |
| 1,193,068 | 8/1916 | Roberts | 202/133 |
| 1,193,068 | 8/1916 | Roberts | 202/133 |
| 2,340,981 | 2/1944 | Otto | 202/222 |
| 2,376,718 | 5/1945 | Otto | 202/133 |
| 3,042,589 | 7/1962 | Otto | 202/223 |
| 3,192,129 | 6/1965 | Becker | 202/223 |
| 3,633,855 | 1/1972 | Klippe | 52/573 |
| 3,879,905 | 4/1975 | Catalano, Sr. | 52/294 |

*Primary Examiner*—Jack Sofer
*Attorney, Agent, or Firm*—Brown, Murray, Flick & Peckham

[57] ABSTRACT

This disclosure relates to reinforced support walls arranged to extend transversely of the length of a battery of coke ovens in a cellar for supporting battery decking of underjet coke ovens. Ducts extend in the cellar for supplying gaseous combustion media to the heating flues of the heating walls and control members are arranged in the cellar to control the flow of the combustion media in the individual ducts. A foundation slab includes reinforcement members bonded to reinforcement members within the support walls. Expansion joints, including slip plates, are arranged between the support walls and the battery decking. The decking may include a projection extending downwardly along the center line of the battery for bonding engagement with the support walls.

5 Claims, 4 Drawing Figures

SUPPORT APPARATUS FOR A BATTERY OF COKE OVENS

BACKGROUND OF THE INVENTION

This invention relates to underjet coke ovens, and more particularly to a support apparatus for carrying battery decking for the coke ovens above a cellar wherein supply ducts are arranged for conducting combustion media to the heating flues of the heating walls for the coke ovens.

More specifically, the present invention provides support means for battery decking which is positioned above an underground room or cellar having a foundation slab that carries the support walls and within the cellar, there extends supply ducts to conduct gaseous combustion media to the heating flues for the heating walls and within the cellar there is also provided control members to regulate the flow of gas in each of the supply ducts by adjustments carried out within the cellar.

In order to adequately support battery decking, which is also referred to in the art as nozzle decking, it is necessary inter alia to allow for expansion of the oven brickwork. The battery decking or nozzle decking is associated with regulating elements which are frequently disposed in gas supply ducts and take the form of nozzles. The support for the battery decking must be designed in such a manner to allow for the fact that the brickwork for the oven battery is subject to elevated temperatures during the heating-up and in the operation of the battery. The oven brickwork itself is subjected to expansions which act in the longitudinal direction of the oven chambers as well as in the longitudinal direction of the battery of coke ovens. Allowances for expansion in the longitudinal direction of the battery of coke ovens are made by the provision of expansion joints in each heating wall of the battery brickwork in vertical planes which extend parallel to the longitudinal axes of the oven chambers. It is also known to provide expansion joints which extend parallel to the oven chambers in the battery decking but usually at greater distances.

Notwithstanding these known constructions, allowance must be made for expansion of the oven decking along the longitudinal direction of the battery of coke ovens by providing strong, longitudinal reinforcement for the decking. The top portion of the battery decking attains a higher temperature than the bottom portion of the decking. This produces or causes the battery decking to expand in the longitudinal direction of the battery of coke ovens. Heretofore, the battery decking was supported by pillars which were arranged in rows parallel to the coke oven chambers. The pillars were connected to the battery decking by means of strong bottom trusses. Since the battery decking expanded to both sides, namely, toward the coke side and toward the pusher side, this meant that substantial forces acted upon the head or top portion of the pillars. These forces, therefore, had to be counteracted by very strong reinforcement for the pillars and the bottom trusses. Such reinforcement required an increased expenditure for material as well as higher wages and costs.

SUMMARY OF THE INVENTION

It is an object of the present invention to provide a construction and arrangement of parts to allow for thermal expansion of a battery decking of coke ovens by the construction and support of battery decking in a manner in contrast to known support construction so as to achieve an improved construction and arrangement of parts with the least possible expenditure in terms of material and with the least required manual labor.

In accordance with the present invention, there is provided in a battery of underjet coke ovens having battery decking positioned above a cellar within which ducts extend for supplying gaseous combustion media to the heating flues of the heating walls for the side-by-side coking chambers forming the coke ovens, the cellar including therein members adapted for actuation to control the flow of gaseous media in the individual ducts, a support apparatus to carry the battery decking above the cellar comprising, reinforced concrete support walls extending parallel and in a direction transversely to the length of the battery of coke ovens for supporting the battery decking, a foundation slab including reinforcement members bonded to the reinforcement members within the support walls, and expansion joints including slip plates located between the support walls and the battery decking.

The aforesaid support walls may additionally include openings having a height which will enable an operator to pass through the openings but which height is less than the height of the supporting walls themselves. In this way, the support walls enable access to the individual parts of the cellar. The support walls can be spaced from one another by the same distance at which rows of conventionally known support pillars have been spaced heretofore, namely, at a pitch equivalent to the distance between the centers of two coke oven chambers. The incorporation of a slip joint between the support walls and the battery decking relieves the support walls of the expansion forces which heretofore acted upon known construction for supporting the battery decking since the support walls of the present invention are required merely to sustain the weight of the coke oven structure. The support walls can be constructed relatively thin and require only moderate reinforcement. This has the added advantage that material as well as labor are saved and furthermore it eliminates the heretofore assumed risk that expansions by the support structure will break the support elements. The reinforcement members which extend parallel to the axes of the coke oven chambers in the foundation slab as well as in the support walls can be relatively thin.

In the event that the characteristics of the subsoil are such as to require or otherwise render essential the employment of piling foundations to carry the coke oven structure, it is possible according to a further embodiment of the present invention to bond the reinforcement members extending from the pile heads into the support walls. The yoke height of the piling is, therefore, reduced. Since the support walls act as very tall girders, the forces due to the loads which are supported by the piling are very uniformly distributed in the walls. Any random arrangement of the piling can, therefore, be adopted in the longitudinal direction of the coke oven chambers. It is not necessary to maintain the usual spacings between supports in the known support substructure for a battery of coke ovens.

The expansion of the battery decking in the direction of the axes of the coke oven chambers is a phenomenon which cannot be avoided. To insure that such expansion will occur in a uniform manner at both sides of the battery decking, the decking is provided with a central and downward projection along the longitudinal axes of the battery of coke oven chambers where it is bonded into the support walls.

These features and advantages of the present invention as well as others will be more readily understood when the following description is read in light of the accompanying drawing, in which.

Figure 1:
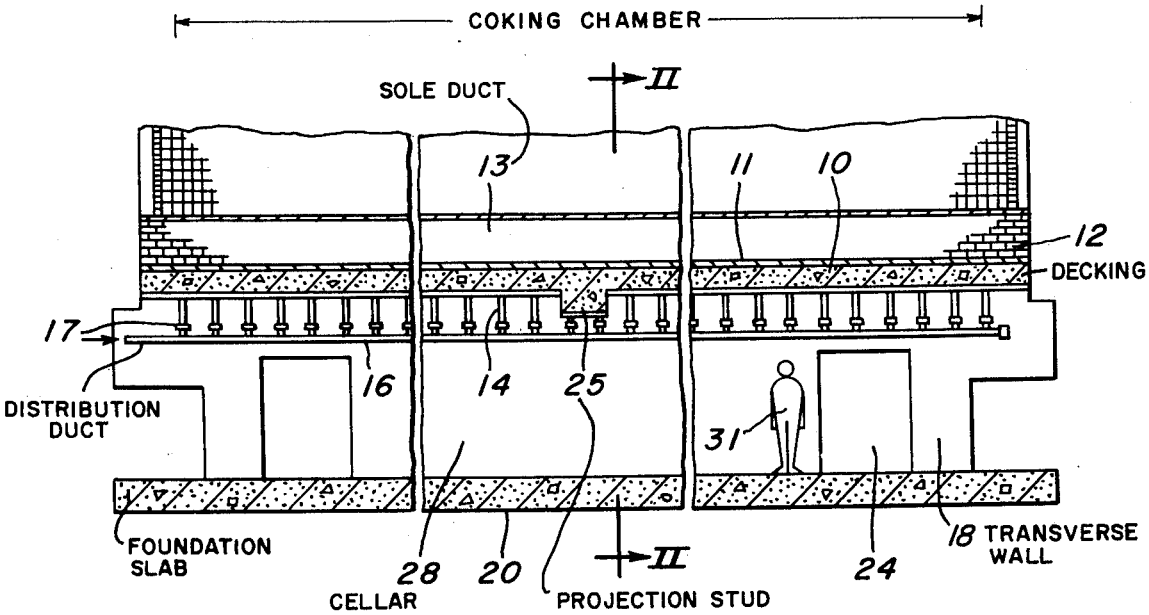
FIG. 1 is a vertical sectional view parallel to the longitudinal axis of a coking chamber and illustrating the substructure to support a battery of underjet coke ovens embodying the features of the present invention.
Figure 2:
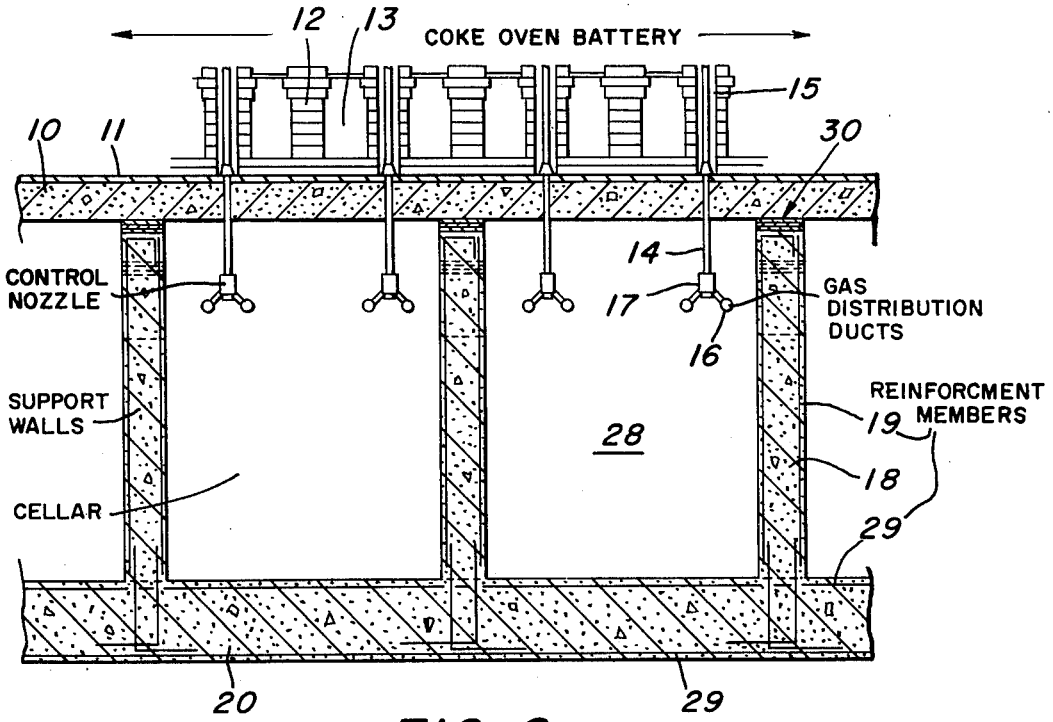
FIG. 2 is a vertical sectional view taken along line II—II of FIG. 1 to illustrate the substructure to support the coking chamber in a direction along the length of the battery of coke ovens.

In FIG. 1, battery decking 10 carries a stratum of insulating concrete 11. Refractory brickwork 12 extends above the stratum of insulating concrete and contains sole ducts 13 which are connected by regulating elements to regenerators disposed above the ducts. In FIG. 1, the pusher side and the coke side of a coking chamber lie at opposite ends of the illustration therein so that the longitudinal axis of the coking chamber extends along the plane of the illustration in FIG. 1 while the longitudinal direction of the battery of coke oven chambers extends perpendicular thereto which is illustrated by FIG. 2.

Vertical pipes 14 traverse the battery decking. These pipes extend at the top into the brick ducts 15 in the regenerator bulkheads and lead to the burners in the heating walls. The vertical pipes 14 are connected to horizontally-arranged distribution ducts 16 for rich gases in a cellar 28. Gas control nozzles 17 are disposed in the supply ducts and these nozzles can be adjusted from the cellar.

Figure 3:
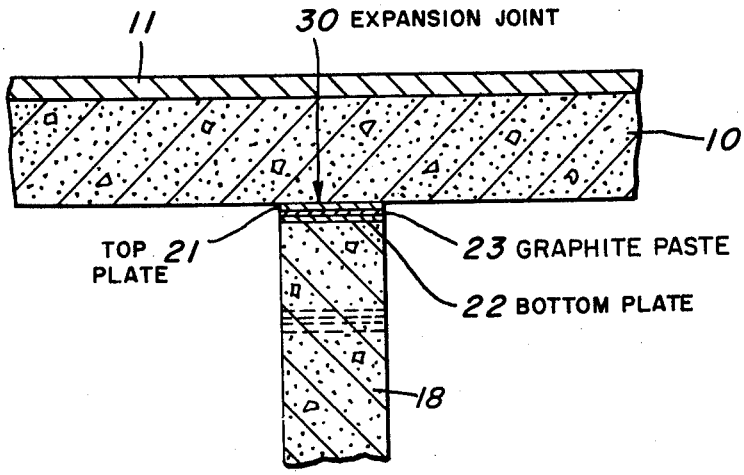
FIG. 3 is a view similar to FIG. 2 and illustrating in an enlarged scale the expansion joint between the battery decking and a support wall according to the present invention.

According to the present invention, the battery decking is supported upon a foundation slab 20 by means of support walls 18 having reinforcement members 19 bonded into or with reinforcement members 29 embedded in the foundation slab. An expansion joint 30, best shown in FIG. 3, permits the battery decking to slide upon the support walls. The expansion joint is provided between the top surface of the support walls 18 and the battery decking 10. The expansion joint includes slip plates formed by a top plate 21, a bottom plate 22 and a layer of graphite paste 23 disposed between the plates 21 and 22. The support walls 18 are provided with openings 24 such that the height of the openings will accommodate workmen or other personnel typically illustrated in FIG. 1 by reference numeral 31. The height of the opening 24 is such that a workman can move about in an upright position through the openings but that height of the openings 24 is less than the height of the support walls 18.

The battery decking 10 has at its bottom surface a downward projection or stud 25 that extends along the longitudinal center plane of the battery of coke ovens which is at right angles to the longitudinal axes of the oven chambers. The stud 25 is bonded into the support walls 18 and insures that the battery decking retains its central position when subjected to expansion forces so that the decking expands from the center thereof.

Figure 4:
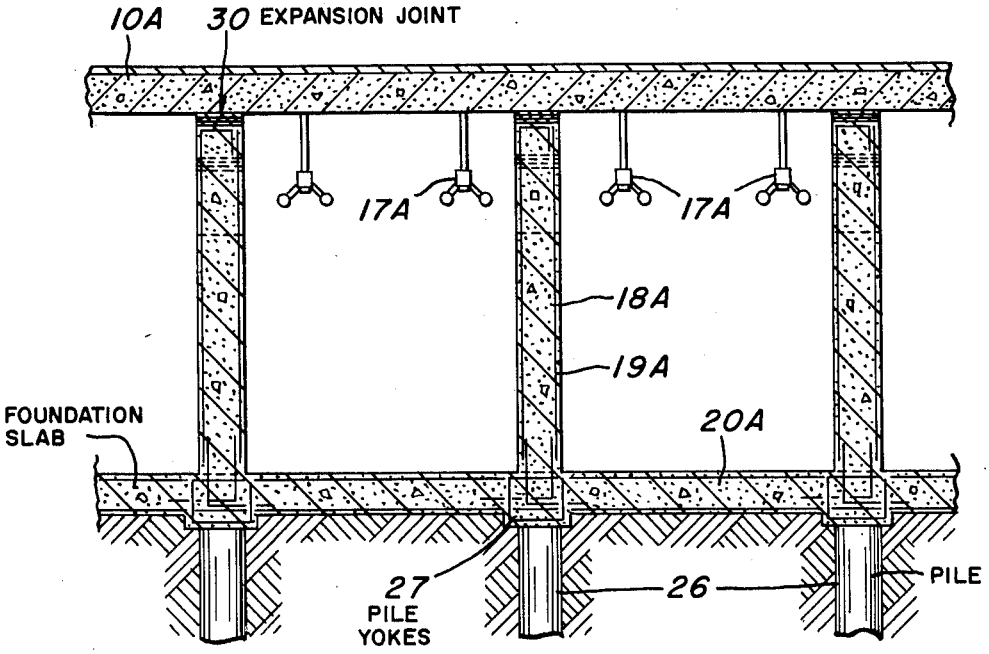
FIG. 4 is a vertical sectional view similar to FIG. 2 and illustrating the substructure of an oven battery including a foundation slab supported by piling.

FIG. 4 illustrates foundation piling 26. The reinforcement members 19A embedded within the support walls 18A are bonded into the foundation slab 20A. The reinforcement members 19A are also bonded into pile yokes 27 of the foundation piles 26. This construction and arrangement of parts makes possible the employment of a substantially weaker reinforcement of the foundation slab 20A in the direction of the longitudinal axes of the coking chambers since the foundation slab 20A is relieved of the expansion forces which act parallel to the longitudinal axes of the coking chambers. The embodiment of FIG. 4 includes the expansion joint 30 constructed and arranged in the same manner as previously described in regard to FIG. 3 for supporting the battery decking 10A.

Although the invention has been shown in connection with the certain specific embodiments, it will be readily apparent to those skilled in the art that various changes in form and arrangement of parts may be made to suit requirements without departing from the spirit and scope of the invention.

I claim as my invention:

1. In a battery of underjet coke ovens having battery decking positioned above a cellar within which ducts extend for supplying gaseous combustion media to the heating flues of the heating walls for the coking chambers forming said coke ovens, the cellar having ducts with nozzle members therein to control the flow of combustible gaseous media in the individual ducts to said flues, a support apparatus to carry said battery decking above said cellar comprising:

concrete support walls extending along only in a parallel direction with respect to the heating walls for the coke oven chambers, said concrete support walls including reinforcement members therein and providing the sole supports for said decking located there above;

a foundation slab including reinforcement members projecting into said concrete support walls, and expansion joints including slip plates between said concrete support walls and said battery decking.

2. The support apparatus of claim 1 wherein said support walls include open passageways therein having a height which is less than the height of the support walls.

3. The support apparatus according to claim 1 further comprising a pile foundation extending below the floor of said cellar and including reinforcement members bonded to the reinforcement members of said support walls.

4. The support apparatus according to claim 1 wherein said decking includes a projection extending downwardly therefrom along a center line of the battery of coke ovens for bonding engagement with said support walls.

5. The support structure according to claim 1 wherein said support walls are spaced from each oth r by a distance which is approximately equal to twice the distance between the longitudinal axes of two adjacent coke oven chambers.

* * * * *